United States Patent [19]

Svoboda

[11] Patent Number: 4,513,988

[45] Date of Patent: Apr. 30, 1985

[54] DEVICE FOR CROSS-COUNTRY SKIING

[75] Inventor: Josef Svoboda, Schwechat, Austria

[73] Assignee: TMC Corporation, Baar, Switzerland

[21] Appl. No.: 413,914

[22] Filed: Sep. 1, 1982

[30] Foreign Application Priority Data

Sep. 11, 1981 [AT] Austria ..... 3946/81

[51] Int. Cl.[3] ..... A63C 9/081

[52] U.S. Cl. ..... 280/615; 280/618

[58] Field of Search ..... 280/614, 615 OR, 618, 280/620; 248/300

[56] References Cited

U.S. PATENT DOCUMENTS

| | | | |
|---|---|---|---|
| 1,845,808 | 2/1932 | Oishei | 248/300 |
| 4,002,354 | 1/1977 | Ramer | 280/614 |

FOREIGN PATENT DOCUMENTS

| | | |
|---|---|---|
| 343522 | 6/1978 | Austria . |
| 351979 | 8/1979 | Austria . |
| 2064754 | 7/1972 | Fed. Rep. of Germany . |
| 2490099 | 3/1982 | France . |

*Primary Examiner*—Joseph F. Peters, Jr.
*Assistant Examiner*—Joseph G. McCarthy
*Attorney, Agent, or Firm*—Flynn, Thiel, Boutell & Tanis

[57] ABSTRACT

A safety ski binding includes a cross-country plate having a front jaw and heel holder thereon and pivotal about an axis extending transversely of the ski. Two W-shaped bar parts of different lengths are pivotally supported thereon and movable to positions between the plate and ski. Each bar part includes two spaced outer legs, two spaced inner legs therebetween, two support webs connecting adjacent outer and inner legs, and an inner web connecting the two inner legs. A respective pin extends through the inner legs of each bar part and is secured in the outer legs thereof, and portions of a sleeve are provided on the pin between each outer leg and the adjacent inner leg and between the inner legs. A further pin is preferably secured in the outer legs of one bar part and engages the inner web thereof. Damper elements are preferably provided on the support webs of each bar part.

19 Claims, 7 Drawing Figures

DEVICE FOR CROSS-COUNTRY SKIING

FIELD OF THE INVENTION

This invention relates to a cross-country skiing device for a safety ski binding.

BACKGROUND OF THE INVENTION

A known arrangement includes a safety ski binding which has a cross-country plate with a front jaw and a heel holder thereon, the cross-country plate being pivotal about an axis which extends transversely to the longitudinal axis of the ski and supporting a bar which is generally W-shaped and can be swung into a position below the cross-country plate for the cross-country skiing, in which position the bar is held by stops provided on both sides, preferably on the cross-country plate. The bar can be swung to a retracted position for downhill skiing and, in relationship to the plane of the cross-country plate, can be adjusted to different heights. The bar is preferably constructed in two parts, one bar part being swingable relative to the other bar part, preferably thereon. An arrangement of this type is disclosed in Austrian patent application No. A 4625/80.

The device which is described in the mentioned application has proven itself well in practice, since it can be operated comfortably and permits the skier to select, during cross-country skiing and depending on the condition of the terrain, an elevational adjustment of the bar which is the most comfortable for him. In the case of high stresses, however, it has been found that permanent deformation of the bar parts can occur.

Therefore, one purpose of the present invention is to improve and further develop a device of the above-mentioned type so that it better resists high stresses.

SUMMARY OF THE INVENTION

This purpose is attained inventively by providing an arrangement of the foregoing type and arranging or securing on each bar part, between the legs of the bar part, at least one connecting and/or spacing arrangement, or by filling the space between the legs of each bar part, at least partially, with a reinforcing or filling material.

Each structural part can be reinforced sufficiently by the inventive measure so that it withstands large stresses during use by the skier. Thus, the danger of deformation of the bar parts is avoided.

In this connection, it is advantageous if one bar part is arranged within the other bar part, and if each bar part includes two outer and inner legs, the two outer legs transferring into the two inner legs through support webs, and the inner legs extending at a small angle to the outer legs, being located between these, preferably having a length one-fourth to one-half of the length of the outer legs, and being connected to one another by an inner web. This inventive shape of each bar part favorably influences its stability and at the same time permits unhindered swivelling of the two bar parts relative to one another.

One embodiment of the invention is characterized by the connecting and/or spacing arrangement including multi-part sleeves which are supported on respective pins which are secured on the outer legs of the respective bar parts and extend through the two inner legs thereof. The sleeves are provided between each outer leg and the associated inner leg and between the two inner legs. In this manner, the inner and outer legs of the bar parts are reinforced with respect to one another in a simple manner.

A further characteristic of the invention consists in the connecting and/or spacing arrangement including a pin which extends parallel to the inner web of the inner bar part, is arranged in contact therewith; is secured on the two outer legs thereof, and in the position of use of the inner bar part can support a heel holder part, preferably the housing of the heel holder. With this, a transfer and distribution of the forces applied by the skier during cross-country skiing is effected onto the outer legs and also the inner legs of the bar part.

A further embodiment of the invention provides that the reinforcing or fill material accurately fits in and fills at least the spaces between each outer leg and the associated inner leg of each bar part.

In a particularly simple embodiment of the invention, the connecting and/or spacing arrangement includes a reinforcing plate which can be moved, by means of a recess constructed in its center region, onto or rather over the inner web of each bar part, the ends of the plate engaging the inner surfaces of the two outer legs of each bar part.

In order to avoid a hard hitting of either bar part on the ski during cross-country skiing, and to assure in this manner more comfortable skiing, it is advantageous if, inventively, a damper element is secured on each support web of each bar part, which damper elements are preferably manufactured of a slightly elastic material, for example a plastic.

BRIEF DESCRIPTION OF THE DRAWING

Further charcteristics, advantages and details of the invention will now be described in connection with the drawing, which illustrates several exemplary embodiments.

In the drawing.

DETAILED DESCRIPTION

Figure 1:
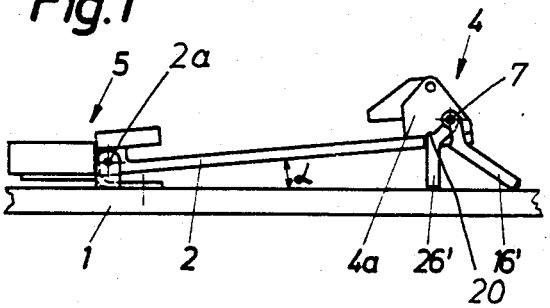
FIGS. 1 and 2 are elevational side views of a safety ski binding which can be used for cross-country skiing and embodies the present invention.
Figure 2:
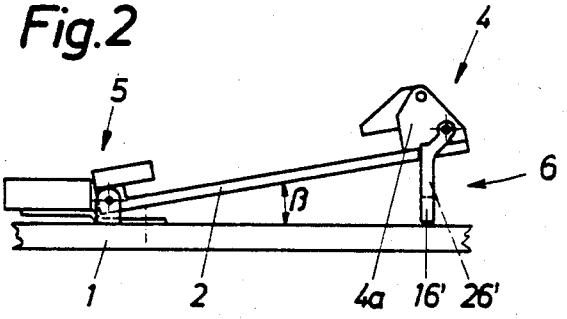

FIGS. 1 and 2 illustrate a safety ski binding which can be used for cross-country skiing, is similar in some respects to bindings disclosed in Austrian Pat. Nos. 343 522 and 351 979, and is supported in a conventional manner on a ski 1. The safety ski binding has a cross-country plate 2 which is pivotal about an axle 2*a* which extends transversely of the longitudinal axis of the ski. The plate 2 carries a heel holder 4 and also part of a front jaw 5, the other part of which is secured on the ski 1. Since the details of the binding are not part of the subject matter of the present invention, its design is not discussed in detail.

Figure 4:
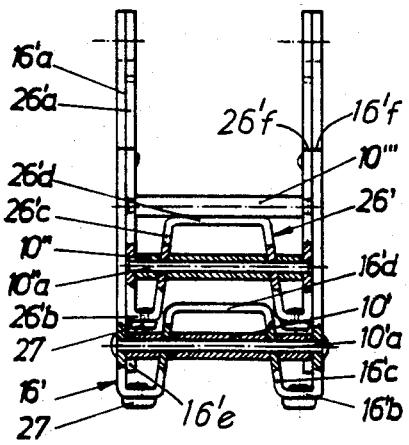
FIG. 4 is a front view of the device of FIG. 3.

The invention relates to a device 6 which is pivotally supported on the housing 4*a* of the heel holder 4 and includes two bar parts 16' and 26' (FIG. 4).

The two bar parts 16' and 26' are preferably made of a flat material and, with the bar part 26' lying within the bar part 16', are each pivotally supported on the housing 4a of the heel holder 4 by a common axle 7. The two bar parts 16' and 26' are, for example, pivotally supported by rivets on the housing 4a.

In a front view (FIG. 4), the two bar parts 16' and 26' are each approximately W-shaped. Each of the bar parts 16' and 26' has two respective outer legs 16'a and 26'a which extend parallel to one another and transfer at their lower ends into inner legs 16'c and 26'c through support webs 16'b and 26'b. In the present exemplary embodiment, the legs 16'c and the legs 26'c are arranged at a small angle to the legs 16'a and 26'a, respectively, and are connected at their upper ends by means of respective inner webs 16'd and 26'd which extend parallel to the support webs 16'b and 26'b. The length of the two outer legs 26'a of the bar part 26', which when not in use is disposed within the bar part 16', is less than the length of the outer legs 16'a of the bar part 16'. Thus, during use of the longer bar part 16' (FIG. 2), an angle $\beta$ of approximately 10° between the upper side of the ski and the cross-country plate 2 is obtained, and during use of the shorter bar part 26' (FIG. 1) an angle $\alpha$ of approximately 5° between the upper side of the ski and the cross-country plate 2 is obtained. These two angles $\alpha$ and $\beta$ are, according to experience, particularly suitable angles for cross-country skiing.

In a side view (FIG. 3), each of the outer legs 16'a and 26'a is angled approximately in its center area, and the two portions of each leg which are thus defined form an obtuse angle with respect to one another. In this manner, the leg portions adjacent the support webs 16'b and 26'b rest flat on the upper side of the ski when not in use, and the other leg portions extend upwardly at an incline on opposite sides of the housing 4a of the heel holder 4. Thus, an indesirable catching of the two bar parts 16' and 26' on obstacles is avoided.

The outer legs 16'a of the bar part 16' have, at the edges thereof opposite the edges which rest on the upper side of the ski when the device 6 is not in use, respective flanges 16'e which project inwardly toward the bar part 26' which lies on the inside. These flanges 16'e cause, during swinging of the device 6 to a position below the cross-country plate 2, for example by means of a ski pole, the bar part 26' to be carried along by the bar part 16'.

The edges of the outer legs 16'a of the outer bar part 16' which are opposite the edges having the flanges 16'e, and also the corresponding edges of the outer legs 26'a of the inner bar part 26', each have a respective step 16'f or 26'f. During pivotal movement of the device 6 into a position for cross-country skiing, these steps on the outer legs 26'a and 16'a come to rest against congruently constructed stop surfaces 20 on the heel holder 4, which stop surfaces can alternatively be provided on the cross-country plate 2. Through this, the stops act as supports for the bar parts 16' and 26' in addition to preventing unintended swivelling of the bar parts 16' and 26'.

The operation of the device is very simple. When not in use, the outer legs 16'a and 26'a of the device extend behind the heel holder 4 and portions thereof rest on the upper side of the ski. The bar parts 16' and 26' are pivotally supported on the heel holder 4 in such a manner that unintended swivelling thereof is prevented, which also prevents any annoying rattling of the bar parts 16' and 26' on the upper side of the ski. When the device is needed, then it is sufficient to release a lock mechanism for the cross-country plate 2 which is not inventive and is therefore not illustrated or described, and then to lift the cross-country plate 2 with the inserted ski shoe. The device 6 is then swung with a ski pole in clockwise direction to a position below the cross-country plate 2 (FIG. 2) whereby the bar part 16' takes along the bar part 26'. The stop surfaces 20 which are provided on the heel holder 4 or on the cross-country plate 2 prevent, on the one hand, excessive swivelling of the device and assure, on the other hand, an optimum orientation of the device 6 relative to the upper side of the ski. In this position of the device 6, the cross-country plate 2 and the upper side of the ski define the angle $\beta$ (FIG. 2). If a lesser rise is to be overcome, then the skier swings, for example by means of his ski pole, the bar part 16' in a counterclockwise direction by up to 180°, the second, shorter bar part 26' remaining in its effective position (FIG. 1).

The legs 16'a and 16'c and the legs 26'a and 26'c of the bar parts 16' and 26' are reinforced or connected by means of a connecting or spacing arrangement or fill members. The connecting or spacing arrangement, in the exemplary embodiment, includes multi-part sleeves 10' and 10'' (FIG. 4). Each of the bar parts 16' and 26' have, in the region of its inner legs 16'c and 26'c, a respective pin 10'a or 10''a which extends parallel to the inner webs 16'd and 26'd and extends through openings in the legs 16'a and 16'c or 26'a and 26'b, respectively. The ends of the pins 10'a and 10''a are upset against the outer legs 16'a and 26'a. Between each of the outer leg 16'a and 26'a and the adjacent inner leg 16'c and 26'c, and between the two inner legs 16'c or 26'c, respective portions of the sleeves 10', 10'' are provided on the pins 10'a, 10''a. In this manner, not only is reinforcement of the entire bar parts 16' and 26' achieved, but bending of the legs 16'a and 16'c or 26'a and 26'c during high stresses in a manner which could result in a permanent deformation is avoided.

A pin 10''' which also extends parallel to the inner web 26'd is secured on the outer legs 26'a of the inner bar part 26', which pin 10''' contacts the upper surface of the inner web 26'd. When this bar part 26' is in the position of use for cross-country skiing, then the housing 4a of the heel holder 4 is supported by means of its sidewalls on the pin 10'''. With this, pressure applied to the binding by the skier during skiing is transferred onto both the outer legs 26'a and the inner legs 26'c of the bar part 26'.

The openings in the legs 26'a for the pins 10''a and 10''' are preferably slightly countersunk, and the ends of these pins are flush with the outer surfaces of the legs 26'a to avoid interference between the pins and the legs 16'a of the bar part 26' as the bar parts 16' and 26' pivot relative to each other.

The sleeves 10' and 10'' are preferably made of a relatively rigid material, and the portions thereof each have their ends firmly contacting the respective legs of the bar parts 16' and 26' between which they are disposed.

Figure 3:
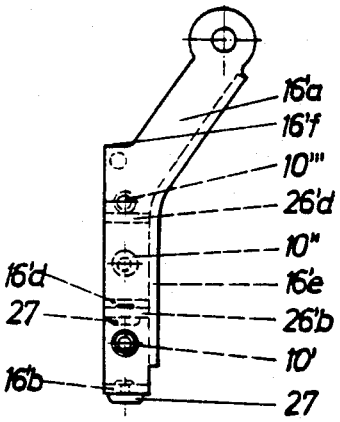
FIG. 3 is a side view of a first exemplary embodiment of a device which is a component of the binding of FIG. 1.

As can further be seen from FIGS. 3 and 4, a damper element 27 is provided on each of the support webs 16'b and 26'b of each of the bar parts 16' and 26', for example by insertion into an opening in the support webs 16'b or 26'b. The damper elements 27 are manufactured of a slightly elastic material, for example a plastic, and contribute to more comfortable cross-country skiing, since a hard hitting of the bar parts 16' and 26' onto the upper side of the ski is avoided.

Figure 5:
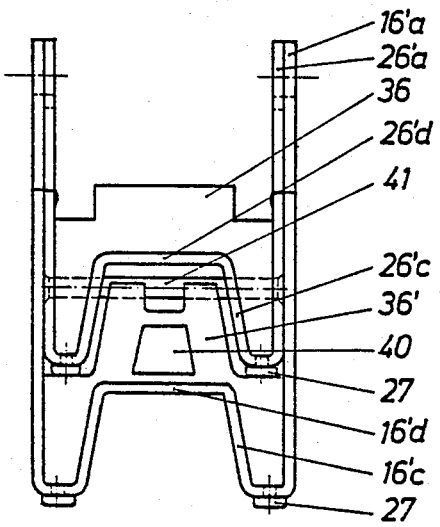
FIG. 5 is a front view of another embodiment of the device of FIG. 1.
Figure 6:
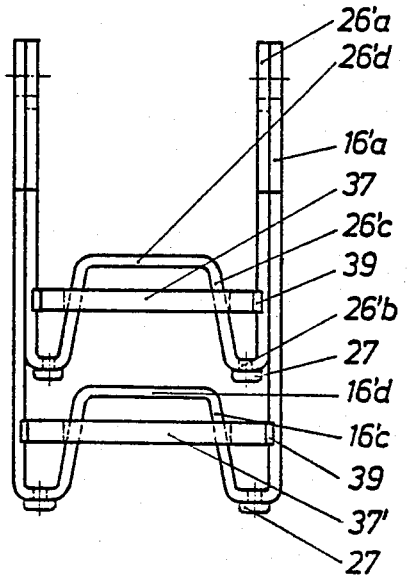
FIG. 6 is a front view of yet another embodiment of the device of FIG. 1.
Figure 6A:
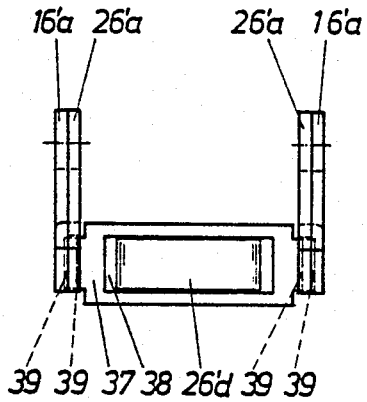
FIG. 6*a* is a top view of the device of FIG. 6.

To reinforce and stiffen the bar parts 16' and 26', it is also possible to use plastic fill members 36, 36'. As can be seen from FIG. 5, these fill members 36, 36' are designed such that they accurately fit into and fill the spaces between the outer legs 16'a or 26'a and the inner legs 16'c or 26'c and, in addition, reinforce the region above the inner webs 16'd and 26'd. In this case, support of the housing 4a of the heel holder 4 on the fill member 36 also occurs in the case of the use of the smaller bar part 26'. It is also possible to provide one of the fill members 36, 36' or both with reinforcing webs or cavities. As can be seen from FIG. 5, the fill member 36' has a cavity 40 and the fill member 36 is stiffened by a web 41. As can further be seen from FIGS. 6 and 6a it is also conceivable to provide reinforcing plates 37, 37' which have a recess 38, by means of which they can be moved over the inner webs 16'd and 26'd of the bar parts 16' and 26'. The ends of the reinforcing plates 37, 37' could engage locking recesses 39 which are constructed on the inner sides of the outer legs 16'a and 26'a of the respective bar parts 16' and 26'.

The invention is not limited to the illustrated exemplary embodiment. Further modifications, including the rearrangement of parts, are conceivable without leaving the scope of the claims. For example, it is possible to also include a sleeve which provides additional support of the outer legs and is disposed on the pin which is secured on the inner bar part above the inner web. Of course, it is also conceivable to reinforce only the areas between corresponding inner and outer legs by means of pins and sleeves supported thereon. Furthermore, it is possible to manufacture the damper elements of the material of the associated bar part and, if desired, with a Shore hardness which differs from the Shore hardness of the remainder of the bar part. In this manner, working steps can be saved during the manufacturing thereof.

The embodiments of the invention in which an exclusive property or privilege is claimed are defined as follows:

1. A cross-country skiing device for a safety ski binding, comprising a cross-country plate with a front jaw and a heel holder, said cross-country plate being pivotal about an axis which extends transversely with respect to the longitudinal axis of the ski and movably supporting a bar which can be swung into a position below said cross-country plate for cross-country skiing, in which position said bar is held against further movement by stops provided on both sides of said cross-country plate, wherein said bar can be swung into a retracted position for downhill skiing, and wherein said bar, in relationship to the plane of said cross-country plate, can be adjusted to have different heights and includes two bar parts which each have two spaced legs, one said bar part being supported for pivotal movement relative to the other said bar part, and including reinforcing means disposed between and cooperable with said legs of each said bar part for rigidifying each said bar part.

2. The device according to claim 1, wherein said one bar part is arranged within said other bar part, wherein said legs of each said bar part are outer legs, and wherein each said bar part includes two inner legs, said outer legs transferring into said inner legs through respective support webs, and said inner legs being located in the region between said outer legs, having one-fourth to one-half the length thereof, and being connected with one another by an inner web.

3. The device according to claim 2, wherein each said reinforcing means includes three sleeves supported on a pin which is secured on said outer legs of the associated bar part and extends through said inner legs thereof, two of said sleeves each being arranged on said pin in the region between a respective said outer leg and the associated inner leg and the other sleeve being arranged on said pin in the region between said inner legs.

4. The device according to claim 2, wherein said reinforcing means includes a pin which extends parallel to and is disposed against said inner web of said one bar part and which is secured on said outer legs of said one bar part, and wherein said pin, in a position of use of said one bar part is engaged by said cross-country plate.

5. The device according to claim 2, wherein said reinforcing means includes a fill member which accurately fits into and fills the space between each said outer leg and the associated inner leg of the associated bar part.

6. The device according to claim 2, wherein said reinforcing means includes a reinforcing plate having a recess provided in its center region which receives said inner web of the associated bar part, and having ends which engage inner surfaces of said outer legs of the associated bar part.

7. The device according to claim 2, including a damper element secured on each said support web of each said bar part, said damper elements being made of a slightly elastic material.

8. The device according to claim 5, wherein each said fill member has cavities therein.

9. The device according to claim 7, wherein said damper elements are manufactured of the material of the associated bar part but have a Shore hardness which differs from the Shore hardness of the remainder of such bar part.

10. The device according to claim 5, wherein each said fill member has a reinforcing web.

11. The device according to claim 5, wherein each said fill member has a cavity therein.

12. A safety ski binding adapted to be secured to a ski and to releasably hold a ski boot on the ski, comprising a plate supported on the ski at one end for pivotal movement about a transverse horizontal first pivot axis between a downhill skiing position adjacent and approximately parallel to the ski and a raised position extending upwardly at an angle to the ski; a toe holder provided in the region of said pivot axis; heel holder means supported on said plate at a location spaced from said pivot axis; a bar supported on said plate for movement between a retracted position in which said plate can pivot between said raised and downhill skiing positions free from interference by said bar and an operational position in which said bar limits pivotal movement of said plate to movement between said raised position and a first limit position located between said raised and downhill skiing positions, said bar having two spaced first legs; and reinforcing means disposed between and cooperable with said first legs of said bar for rigidifying said bar.

13. The binding according to claim 12, wherein said bar is supported on said plate for pivotal movement between its retracted and operational positions about a second pivot axis which is spaced radially from said first pivot axis and is located near one end of each said first leg; and wherein said bar includes two spaced second legs which are shorter than and are disposed between said first legs, two support webs which each connect an end of a respective said first leg remote from said second pivot axis to an end of a respective said second leg, and an inner web extending between the other ends of said second legs.

14. The binding according to claim 13, wherein said reinforcing means includes an elongate pin which extends through openings provided in said second legs and has its ends fixedly secured to said first legs of said bar, includes a first sleeve encircling said pin between and having its ends disposed against said second legs, and includes two second sleeves, each said second sleeve encircling said pin between and having its ends disposed against a respective one of said first legs and the adjacent second leg.

15. The binding according to claim 14, wherein said reinforcing means includes a further pin which extends parallel to and is disposed against said inner web of said bar, and which has its ends fixedly secured to said first legs of said bar, wherein when said bar is in its operational position, said further pin engages said plate.

16. The binding according to claim 13, wherein said reinforcing means includes a fill member which fits snugly into and fills the space between each said first leg and the associated second leg of said bar.

17. The binding according to claim 13, wherein said reinforcing means includes a reinforcing plate having a recess provided in a center region thereof, said second legs of said bar part extending through and engaging opposite ends of said recess, and opposite ends of said plate each engaging an inner surface of a respective one of said first legs of said bar.

18. The binding according to claim 13, including a further bar which is supported on said plate for pivotal movement about said second pivot axis independently of said first-mentioned bar between a retracted position and an operational position, said first legs of said first-mentioned bar being shorter than said first legs of said further bar and said first-mentioned bar being movable relative to said further bar to a position in which said first-mentioned bar is disposed between said first legs of said further bar wherein when each said bar is in its retracted position said plate can freely move between its raised and downhill skiing positions, and wherein when said further bar is in its operational position said further bar limits movement of said plate to movement between said raised position and a second limit position located between said raised position and said first limit position.

19. The binding according to claim 18, wherein said first legs of each said bar part each include two portions which are arranged at an angle with respect to each other, and wherein said further bar has means defining a flange thereon which is engageable with said first-mentioned bar for causing said first-mentioned bar to move from its retracted to its operational position as said further bar is moved from its retracted to its operational position.

* * * * *